US006641242B2

(12) United States Patent
Canti et al.

(10) Patent No.: US 6,641,242 B2
(45) Date of Patent: Nov. 4, 2003

(54) METHOD AND SYSTEMS FOR CONTROLLING PRINTER TEMPERATURE

(75) Inventors: Pere Josep Canti, Sabadell Barcelona (ES); Carlos Millan, Granollers Barcelona (ES); Roger Vinas, Sant Cugat del Valles Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/874,143

(22) Filed: Jun. 6, 2001

(65) Prior Publication Data

US 2002/0186266 A1 Dec. 12, 2002

(51) Int. Cl.[7] ..... B41J 29/38
(52) U.S. Cl. ..... 347/17; 397/14; 397/41
(58) Field of Search ..... 347/14, 18, 17, 347/12, 19, 188, 189, 16, 194; 400/120.04

(56) References Cited

U.S. PATENT DOCUMENTS 4,910,528 A * 3/1990 Firl et al. ..... 346/1.1
5,477,246 A * 12/1995 Hirabayashi et al. ..... 347/12
5,610,638 A * 3/1997 Courtney ..... 347/14
5,790,144 A * 8/1998 Eade et al. ..... 347/18
5,999,204 A * 12/1999 Kojima ..... 347/194
6,050,666 A 4/2000 Yeoh et al. ..... 347/16
6,068,363 A * 5/2000 Saito ..... 347/17
6,145,959 A 11/2000 Lund et al. ..... 347/40
6,213,579 B1 * 4/2001 Cornell et al. ..... 347/14

* cited by examiner

*Primary Examiner*—Judy Nguyen
*Assistant Examiner*—Lam Nguyen
(74) *Attorney, Agent, or Firm*—Lee & Hayes, PLLC

(57) ABSTRACT

A system and method for providing thermal protection to printheads in a large format ink jet printer. In the system and method, an adaptive thermal print swath servo ("ATPSS") module configured to divide a swath of a print operation into a plurality of individual cells is utilized. In a preferred embodiment, each cell is approximately four (4) inches long, although a user may configure the cell length for any length. The ATPSS module may be further configured to predict a peak temperature of each printhead in printing each cell of a swath. If any of the printheads is predicted to exceed a maximum allowed temperature (e.g., predetermined by the printhead manufacturer) in printing any of the cells, the ATPSS module may be further configured to divide an upcoming pass of the printhead across a recording medium into a series of sub-passes. In this respect, the upcoming pass is decomposed into a series of sub-passes by the utilizing a respective predetermined mask, which subsequently reduces a drop frequency (drops/time) proportionately to the number of sub-passes while maintaining the swath height. The predetermined mask divides the upcoming pass into an equivalent number of sub-passes without advancing the recording medium. Accordingly, the ATPSS module may preserve the life of the printheads by avoiding excessive heat generation in the printheads.

42 Claims, 6 Drawing Sheets

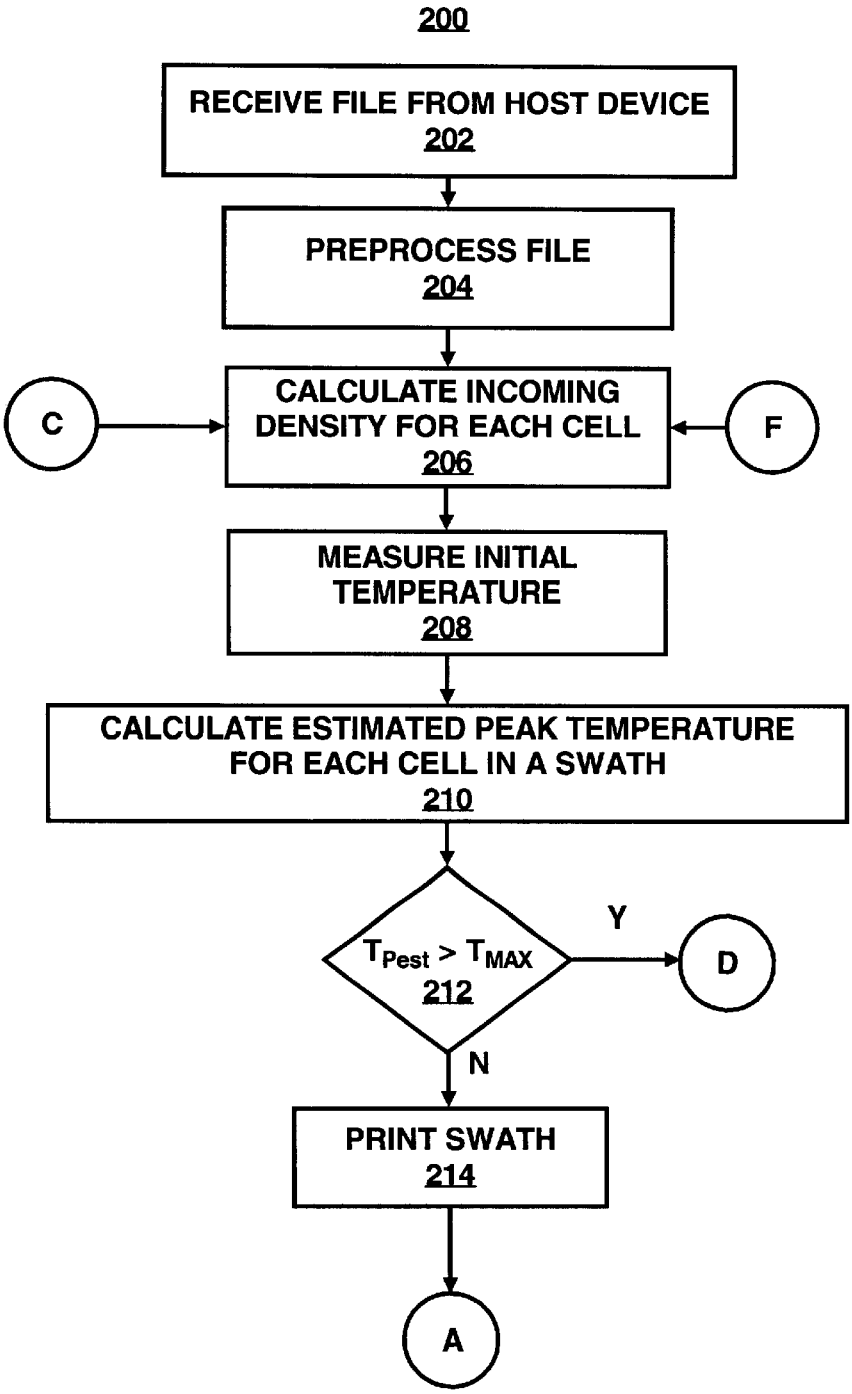
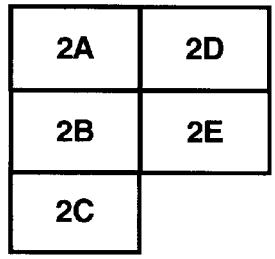
Fig. 2
Fig. 2A

METHOD AND SYSTEMS FOR CONTROLLING PRINTER TEMPERATURE

FIELD OF THE INVENTION

The invention relates to ink jet printers. More particularly, the invention relates to the thermal management of printheads in large format ink jet printers.

DESCRIPTION OF THE RELATED ART

Many modern printing devices incorporate thermal ink jet technology. Typically, this technology utilizes a printhead (also known as a pen) having a silicon die supporting one or more vaporization chambers. During a printing operation, resistors or other ink ejection elements on the silicon die are heated to vaporize and eject ink through nozzles overlying the vaporization chambers, thereby causing dots of ink to be printed on a recording medium, e.g., paper.

The printhead typically sweeps across the width of the recording medium during a printing operation, and based upon the image to be printed, certain ink ejection elements are activated (i.e., heated) to eject ink through respective nozzles. By virtue of the heat applied to the ink ejection elements during the printing operation, the temperature of the silicon die, and thus the printhead, rises. Thus, generally speaking, the temperature of the printhead will change or fluctuate during the printing operation. More specifically, the temperature of the printhead will be lower when the printer is printing "light" areas or in a slow mode than when the printer is printing "dense" areas or in a fast mode. As the printhead temperature changes, it is typically preferable that the temperature of the silicon die remains below a peak temperature to avoid delamination in the printhead as a direct result of thermal stress.

In a large format ink jet printer, e.g., HEWLETT-PACKARD HP500, the printheads are typically configured to withstand a substantially large amount of heat, especially when printing heavy density images along a large swath. A swath is typically defined as the area on a print media to be printed upon during a single pass of the printhead, e.g., in a HP500 printer, a swath may be 40 inches in length. A swath may thus typically be defined as a number of dots (i.e., a height of the columns of dots) that a printhead may record during a pass along a print direction. Additionally, a swath may be printed during one or more passes across the same horizontal portion, depending upon the selected print mode. Large format ink jet printers typically control heat energy by balancing the heat energy applied to the printhead as a function of the temperature of a silicon die. However, in some print modes, e.g., a fast mode, a normal mode, and the like, the heat energy control may be insufficient to prevent the printhead from exceeding a peak temperature.

One known solution to prevent undue thermal stress in large format ink jet printers is to change the printmode behavior in response to a forecast of an incoming density per swath. In this respect, the incoming density per swath is compared to a past temperature/density to determine a new maximum print density for the incoming swath. If the predicted incoming density per swath is greater than the newly calculated maximum print density, the incoming swath height is reduced. That is, a number of nozzles located near the top and/or bottom ends of the printhead are not employed during the printing operation, thereby reducing the total number of nozzles employed and thus reducing the heat generated in the printhead.

Although the technique of reducing swath height has been found to be a substantially adequate solution, the technique suffers from several drawbacks and disadvantages. For instance, the technique may impact the print quality of the recorded image because the possibility of banding is increased. Banding is the phenomenon, which may result from an attempt to print one swath next to a second swath without providing an overlap of the swaths, such that a line or band is formed between the adjacent swaths. By virtue of the reduction of swath height, the possibility of non-overlap occurring increases, thereby increasing the potential for banding. Moreover, the above-mentioned technique may require an increased amount of time to record an image on a recording medium.

Additionally, the above-described technique implements a linear model prediction algorithm that predicts the density of a following swath. One drawback associated with most known linear models is that they may provide a prediction of an error condition of a predicted maximum density exceeding a set maximum density, but only within a few number of swaths prior to the error condition. As a result, the typical algorithm may incorrectly predict the error condition. Thus, the typical algorithm may not accurately predict when the error condition will occur. Furthermore, the above-described technique does not take into consideration sections of a swath that require a relatively large amount of ink. Thus, when evaluating the peak temperature of the printheads in printing a swath, although the actual number of ink drops may be evaluated, the above-described technique would be unable to determine whether concentrated areas of ink drops would cause the printheads to exceed a maximum temperature.

Moreover, the above-described technique may affect the throughput of the large format ink jet printer. As discussed hereinabove, because the typical algorithm may be unable to predict when the maximum density is exceeded in a sufficiently timely manner, a printer may cease or temporarily halt until the temperature of the printheads reduces to an acceptable level. As a result, a user may be required to wait a relatively unexpectedly long time for completion of the print operation.

Yet another drawback to the swath height reduction technique lies in the inaccuracy of a prediction that an error condition will be triggered. The linear models implemented by the typical prediction algorithms rely on an average of data across a total length of a swath, which in some cases may exceed forty inches. As a result, the linear model may not take into account local high-density zones in a swath. Accordingly, the swath height reduction technique may fail to accurately predict the triggering error condition.

SUMMARY OF INVENTION

In accordance with one aspect, the present invention pertains to a method of managing temperature in a printer. In the method, a file is preprocessed into a plurality of swaths, with each of the swaths being further preprocessed in to a plurality of cells. An estimated peak temperature is calculated for each printhead in printing each of the plurality of cells, and a swath is printed in response to the estimated peak temperature for each printhead in printing each of the cells being below a predetermined maximum temperature. Additionally, a pass of each printhead in printing the swath is divided into a number of sub-passes in response to the estimated peak temperature for each printhead in printing each of the cells being greater than the predetermined maximum temperature.

According to another aspect, the present invention pertains to a system for managing temperature in a printer. The system includes a memory, at least one printhead, and an adaptive thermal print swath servo ("ATPSS") module to preprocess a file stored in the memory into a plurality of swaths. Each swath is further preprocessed into a plurality of cells, such that, the ATPSS module is further configured to calculate an estimated peak temperature for each printhead in printing each cell and to print said swath with said printhead in response to said estimated peak temperature for each printhead in printing each cell being below a predetermined maximum temperature.

According to yet another aspect, the present invention pertains to a computer readable storage medium on which is embedded one or more computer programs, the one or more computer programs implementing a method for managing temperature in a printer. The one or more computer programs including set of instructions, including, preprocessing a printable file into a plurality of swaths, with each swath being further preprocessed into a plurality of cells. Calculating an estimated peak temperature of at least one printhead in printing each cell and printing the swath in response to the estimated peak temperature for each cell being below a predetermined maximum allowed temperature.

Additional advantages and features of the invention will be set forth in part in the description which follows and in part will become apparent to those skilled in the art upon examination of the following or may be learned by practice of the invention.

BRIEF DESCRIPTION OF DRAWINGS

Features and advantages of the present invention will become apparent to those skilled in the art from the following description with reference to the drawings, in which:

FIG. 2 is key to FIGS. 2A–2E; and

FIGS. 2A–E, together, illustrate exemplary flow diagrams of the ATPSS module shown in FIG. 1 in accordance with the principles of the present invention.

DETAILED DESCRIPTION OF PREFERRED EMBODIMENTS

Figure 1:
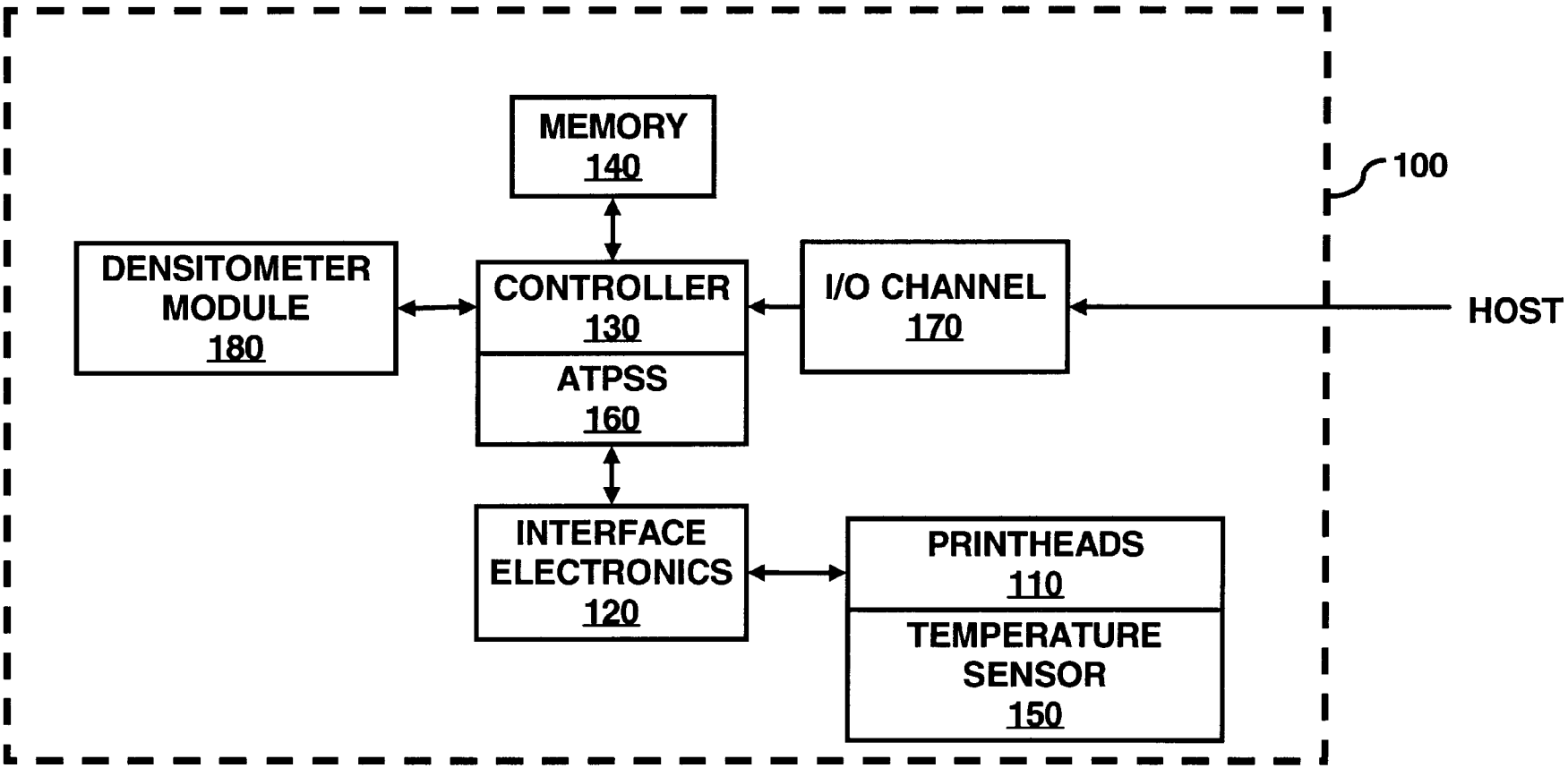
FIG. 1 illustrates an exemplary block diagram of a printer in accordance with the principles of the present invention.

For simplicity and illustrative purposes, the principles of the present invention are described by referring mainly to an exemplary embodiment thereof. Although the preferred embodiment of the invention may be practiced in large format ink jet printers, one of ordinary skill in the art will readily recognize that the same principles are equally applicable to, and can be implemented in any printing device that utilizes thermal regulation, and that any such variation would be within such modifications that do not depart from the true spirit and scope of the present invention. Moreover, in the following detailed description, references are made to the accompanying drawings, which illustrate specific embodiments in which the present invention may be practiced. Electrical, mechanical, logical and structural changes may be made to the embodiments without departing from the spirit and scope of the present invention. The following detailed description is, therefore, not to be taken in a limiting sense and the scope of the present invention is defined by the appended claims and their equivalents.

In accordance with the principles of the present invention, a system for providing thermal protection to printheads in a large format ink jet printer is disclosed. The system includes an adaptive thermal print swath servo ("ATPSS") module. The ATPSS module may be configured to divide a swath (as described hereinabove with respect to the related art) of a print operation into individual cells. That is, prior to performing a print operation of a swath, the ATPSS module may divide the swath into smaller sections called "cells". As will be discussed in greater detail hereinbelow, the ATPSS is configured to calculate the number of drops of ink required to print each of the cells, to thus determine the temperature impact on the printheads caused by dropping the calculated number of ink drops.

According to one aspect of the present invention, the ATPSS module is further configured to predict a peak temperature of each printhead in printing each cell prior to a printing operation of each swath by evaluating the temperature impact on each printhead by the number of ink drops required for each cell. More specifically, if the peak temperature of any of the printheads are predicted to remain below a predetermined maximum temperature (e.g., as determined by the printhead manufacturer), during the printing operation of each of the cells, the printheads are operated to print the swath in one printing pass. However, if the peak temperature of any of the printheads, during the printing of any of the cells, is predicted to exceed the predetermined maximum temperature, the printing operation of the swath is modified to prevent the printhead from exceeding the predetermined maximum temperature.

For example, when it is predicted that a printhead may exceed a predetermined maximum temperature during the printing of a cell in a swath, the ATPSS module divides an upcoming printing pass of the swath into a series of sub-passes, with each sub-pass maintaining the original printing pass swath height. The total number of ink drops fired from the printhead during the sub-passes are configured to be equivalent to a single pass in printing the swath. More specifically, the upcoming pass to print the swath is decomposed into a series of sub-passes by implementing respective predetermined masks, which subsequently reduce a drop frequency (drops/time) proportionately to the number of sub-passes. In this respect, the predetermined masks divide the upcoming pass into an equivalent number of sub-passes without advancing the recording medium.

Although in a preferred embodiment, the predetermined maximum temperature is approximately 70 degrees Celsius, it should be readily apparent to those having ordinary skill that the predetermined maximum temperature may be defined to be any reasonably suitable temperature. By implementation of the ATPSS module, the life of the printheads may be relatively increased.

FIG. 1 illustrates a block diagram of a printer 100 in accordance with the principles of the present invention. The printer 100, in the preferred embodiment, is a large format ink jet printer utilizing at least one printhead 110. Generally speaking, a plurality of printheads may be positioned to hold inks of different colors, such as, yellow, magenta, cyan, and black. Although, for illustrative purposes only, printer 100 is a large format ink jet printer in FIG. 1, it should be understood and readily apparent to those skilled in the art that the ATPSS module disclosed herein may be implemented in any reasonably suitable type of temperature sensitive printer without departing from the scope or spirit of the present invention.

Each printhead 110 may be configured to pass repeatedly across a print (or recording) medium in individual, horizontal swaths to print a selected image (e.g., a picture, text, diagrams, etc.). Each printhead 110 may be further configured to contain multiple ink jet nozzles (not shown), which are each individually fired during a pass to apply an ink pattern onto the print medium.

The printer 100 may be further configured to include interface electronics 120. The interface electronics 120 may be configured to provide an interface between a controller 130 of the printer 100 and the components for moving each printhead 110. The interface electronics 120 may include, for example, circuits for moving each printhead 110, the recording medium, firing individual nozzles, and the like.

The controller 130 may be configured to provide control logic for the printer 100, which provides the functionality for the printer 100. The controller 130 may be implemented with a microprocessor, a micro-controller, an application specific integrated circuit, and the like.

The controller 130 may be interfaced with a memory 140 configured to provide storage of a computer software that provides the functionality of the printer 100 and executed by the controller 130. The memory 140 may be also configured to provide a temporary storage area for data/file received by the printer 100 from a host device, such as a computer, server, workstation, and the like. The memory 140 may be implemented as a combination of volatile and non-volatile memory, such as dynamic random access memory ("RAM"), EEPROM, flash memory, and the like. However, it is within the purview of the present invention that the memory 140 may be included in the host device.

The controller 130 may be further interfaced with a plurality of temperature sensors 150 to detect the temperature of each printhead 110. The temperature sensors 150 may be configured to provide the printhead temperatures to the controller 130. The temperature sensors 150 may be implemented with a thermal sense resistor, thermal sensor, or other device capable of measuring a temperature within a reasonable accuracy.

The controller 130 may be further interfaced with an I/O channel 170 configured to provide a communication channel between a host and the printer 100. The I/O channel may conform to protocols such as RS-232, parallel, small computer system interface, universal serial bus, etc.

The controller 130 may further interfaced with a densitometer 180 configured to estimate an optical density of a reproduced image by scanning, i.e., by counting, the number of pixels in a file stored in the memory 140. The densitometer 180 may be implemented as a separate module or as a software module as part of the control logic of the controller 130. In addition, the densitometer 180 may estimate the number of ink drops required to print an image.

The controller 130 may include an ATPSS module 160 as part of the implemented control logic for the printer 100. The ATPSS module 160 is configured to provide thermal protection for each printhead 110 of printer 100 by dividing a swath into individual cells as discussed hereinabove. The ATPSS module 160 is further configured to predict a peak temperature, $T_{Pest}$, of each printhead 110 for each cell of a swath. In this respect, if a given printhead in a cell is predicted to exceed the maximum temperature, $T_{max}$, (e.g., determined by printhead manufacturer, set by a user, or the like) the ATPSS module 160 is configured to divide, in a printing operation, an upcoming pass of the printhead 110 across a print (recording) medium into a series of sub-passes, each sub-pass being configured to maintain an original pass swath height.

The sub-passes are further configured to be an equivalent of the upcoming pass. The upcoming pass is thus decomposed into a series of sub-passes by utilizing a predetermined mask, which subsequently reduces a drop frequency (drops/time) proportionately to the number of sub-passes. The predetermined mask divides the upcoming pass into an equivalent number of sub-passes without advancing the recording medium. Accordingly, the ATPSS module may preserve the life of the printheads by avoiding excessive heat generation in each printhead 110.

FIGS. 2A–E, together, illustrate an exemplary flow diagram 200 of the ATPSS module 160 shown in FIG. 1, in accordance with the principles of the present invention. In particular, referring first to FIG. 2A, in step 202, the controller 130 may be configured to receive a plot (or print) file from a host device, i.e., a computer, internet, etc. The ATPSS module 160 of the controller 130 may be further configured to preprocess the received plot file, in step 204. The preprocessing of the received plot file may include the step of dividing the plot file into a plurality of swaths by the ATPSS module 160. Additionally, the preprocessing step may also include the step of dividing each swath into a plurality of cells, i.e., cell(1), cell(2) . . . cell(i). Each cell(i) may be configured to be approximately four (4) inches in length. However, the length of each cell may be varied depending on the type of printer and/or a desired resolution, without deviating from the scope and spirit of the present invention.

The ATPSS module 160 may be further configured, for each printhead 110, to calculate a Drop Estimate ("DE(cell (i))") for each cell, i.e., the number of drops of ink required for the printing of the given cell utilizing a densitometer module 180, in step 206.

As will be described in greater detail hereinbelow with respect to step 212, the estimated peak temperatures for each printhead 110 in printing each of the cells is predicted. In calculating the estimated peak temperature for the first cell(1), an initial temperature of each printhead 110 is sensed by respective temperature sensors 150 as indicated in step 208.

In step 210, the ATPSS module 160 may be further configured to estimate $T_{Pest}$ for each printhead 110 in printing each cell(i). The $T_{Pest}$ may be calculated from equation (1):

(1) for i≧1:

$$T_{Pest}(\text{cell}(i))=T_{init}(\text{cell}(i))+(DE(\text{cell}(i))/K)$$

where $T_{init}(\text{cell}(i))=T_{Pest}(\text{cell}(i-1))$ for i>2

$T_{init}(\text{cell}(i))=T_0$ for i=1 (first cell in a given swath)

Where K is determined experimentally and does not equal 0, and $T_0$ is the measured printhead temperature immediately before printing the swath. Cell(i) may designate a given cell in a swath, DE(cell(i)) may designate the drop estimate for cell(i). The constant, K, is determined experimentally (and always nonzero), and $T_{init}$ is the initial temperature of the cell(i). Values for the constant, K, are determined experimentally by studying the thermal response to a range of printed densities of each printhead 110. A value of the constant, K, is chosen for each printhead 110. This value is constantly updated as printing proceeds along a swath based on the algorithms described by equation (2), recited hereinbelow. The constant, K, is allowed to vary within predetermined limits of $K_{max}$ and $K_{min}$ (also specific to each printhead 110), which may also be determined experimentally by sampling a population of printheads of the same type.

As illustrated hereinabove, in calculating the estimated peak temperature of the first cell(1), the measured temperature of each printhead 110, prior to printing of the swath, is employed. In predicting the estimated peak temperature of each printhead 110 in printing the second cell(2), the estimated peak temperature of each printhead 110 in printing the first cell(1) is employed as the initial temperature, $T_{init}$. Similarly, in calculating the estimated peak temperatures of each printhead 110 in printing each of the remaining cells (cell(i)), the estimated peak temperature of each printhead 110 in printing the previous cell(i−1) is employed as the initial temperature, $T_{init}$, in equation (1).

Once the estimated peak temperature, $T_{Pest}$, for each printhead 110 in printing each cell(i) in the swath is calculated, the ATPSS module 160 may be further configured to compare the estimated peak temperature, $T_{Pest}$, of each cell with a maximum allowed temperature, $T_{max}$, within which each printhead 110 may operate safely, in step 212. The maximum allowed temperature, $T_{max}$, is typically an operational parameter for each type of printhead and may thus be set to optimize the functionality of each printhead.

If the estimated peak temperature, $T_{Pest}$, is below the maximum allowed temperature for the printhead, $T_{max}$, for all the cells in the swath, the ATPSS module 160 may be further configured to permit the controller 130 to print the given swath "as is", in step 214.

Prior to printing a subsequent swath, the constant K may be re-evaluated to determine whether a new constant K may improve the values obtained in the calculation of the estimated peak temperatures for the printheads in printing the cells of the prior swath. In determining whether a new constant K may be beneficial, and referring to FIG. 2B, in step 216, the ATPSS module 160 may be further configured to measure and log the initial and final temperatures, $T_i$(cell(i)) and $T_f$(cell(i)) of the printheads 110, respectively, during the printing of each of the cells. The ATPSS module 160 may be further configured to calculate a new constant, $K_{new}$, in steps 218–234. The new constant, $K_{new}$, is calculated from equation (2):

(2) for all cells(i) in the printed swath:
compute the maximum temperature delta, $$T_{Diff}(i)=T_f(\text{cell}(i))-T_i(\text{cell}(i));$$

$$T_{Diff}=\max\{T_{Diff}(i)\}$$

In the calculation of equation (2), for each cell in a swath, the temperatures of the printheads 110 are measured both before ($T_i$(cell(i))) and after ($T_f$(cell(i))) each cell is printed to determine the temperature delta ($T_{diff}$(i)). The temperature deltas for printing each of the cells(i) are compared to one another to determine a maximum temperature delta as indicated in step 218. As indicated in the following equation (3), the number of ink drops printed during the printing of each of the cells(i) is also measured. In this respect, the number of ink drops printed for the cell(i) having the maximum temperature delta ($T_{diff}$(i)) is employed to determine whether a new constant ($K_{new}$), as indicated in step 220, may be beneficial.

(3) with the maximum temperature delta and the number of ink drops printed, determine:

If ($T_{Diff}$>0) and (DropsPrinted>0), then $K_{new}$=DropsPrinted/$T_{Diff}$

If ($K_{new}\geq K_{max}$), return $K_{max}$;

If ($K_{new}\leq K_{min}$), return (K);

Else, return ($K_{new}$)

Where K is the constant, K, from equation (1), $T_f$(cell(i)) designates the final measured temperature of the printhead in printing the cell(i); $T_i$(cell(i)) designates the initial temperature of the cell(i) measured in step 216; the number of printed drops per cell, "DropsPrinted", may be further calculated by the ATPSS module 160 or the interface electronics 120, if properly configured.

Figure 2B:
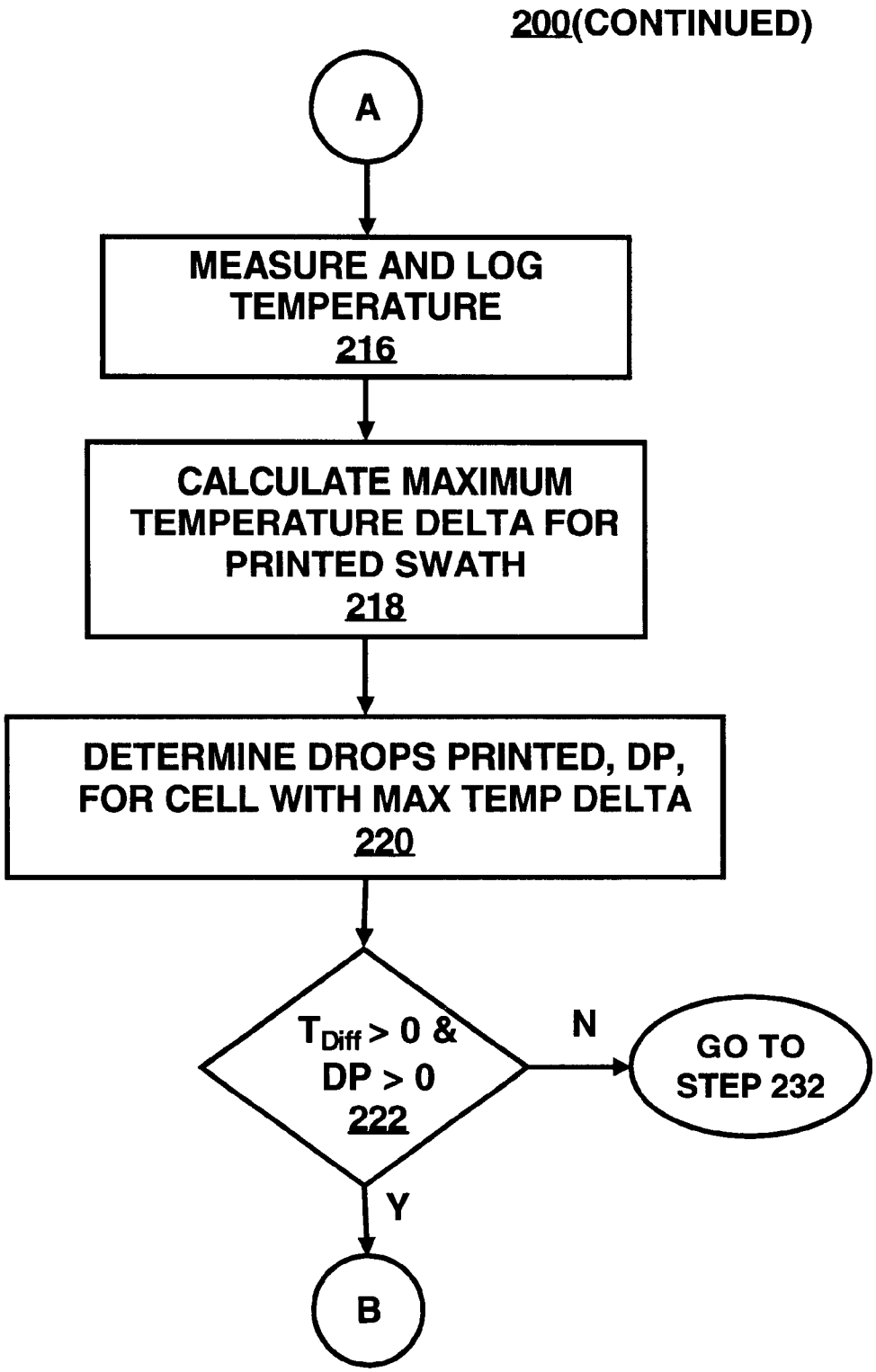
Figure 2C:
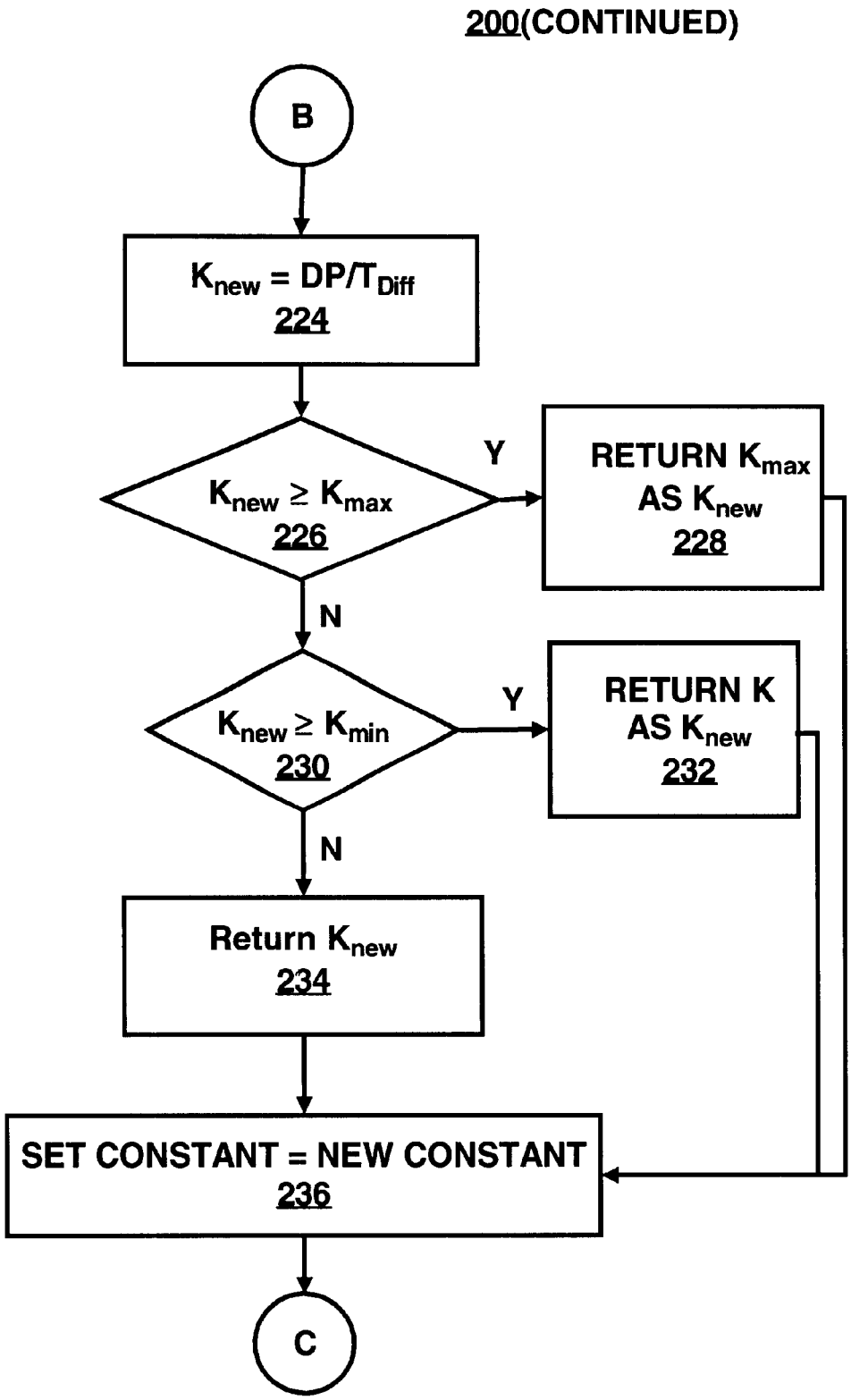

In step 222, if the maximum temperature delta, $T_{Diff}$, is greater than zero and the "DropsPrinted" is greater than zero, the new constant, $K_{new}$, is calculated to be the quotient of "DropsPrinted" over the maximum temperature difference, $T_{Diff}$, in step 224 of FIG. 2C. Otherwise, the ATPSS module 160 is configured to perform step 232, i.e., maintain K from equation (1) as the constant.

Returning to FIG. 2C, in step 226, if the new constant, $K_{new}$, is greater than $K_{max}$, the ATPSS module 160 is further configured to return $K_{max}$ as the new constant, $K_{new}$. Otherwise, in step 230, if the new constant, $K_{new}$, is less than $K_{min}$, the ATPSS module 160 is configured to return the current value of the constant, K, as the new constant, $K_{new}$, in step 232.

Otherwise, if new constant, $K_{new}$, is between $K_{min}$ and $K_{max}$, the ATPSS module 160 is configured to return the calculated value of the new constant, $K_{new}$, from step 224.

In step 236, the new constant, $K_{new}$, is set as the constant, K, for equation (1). The ATPSS module 160 may be further configured to return to step 206 for the next incoming swath.

Figure 2D:
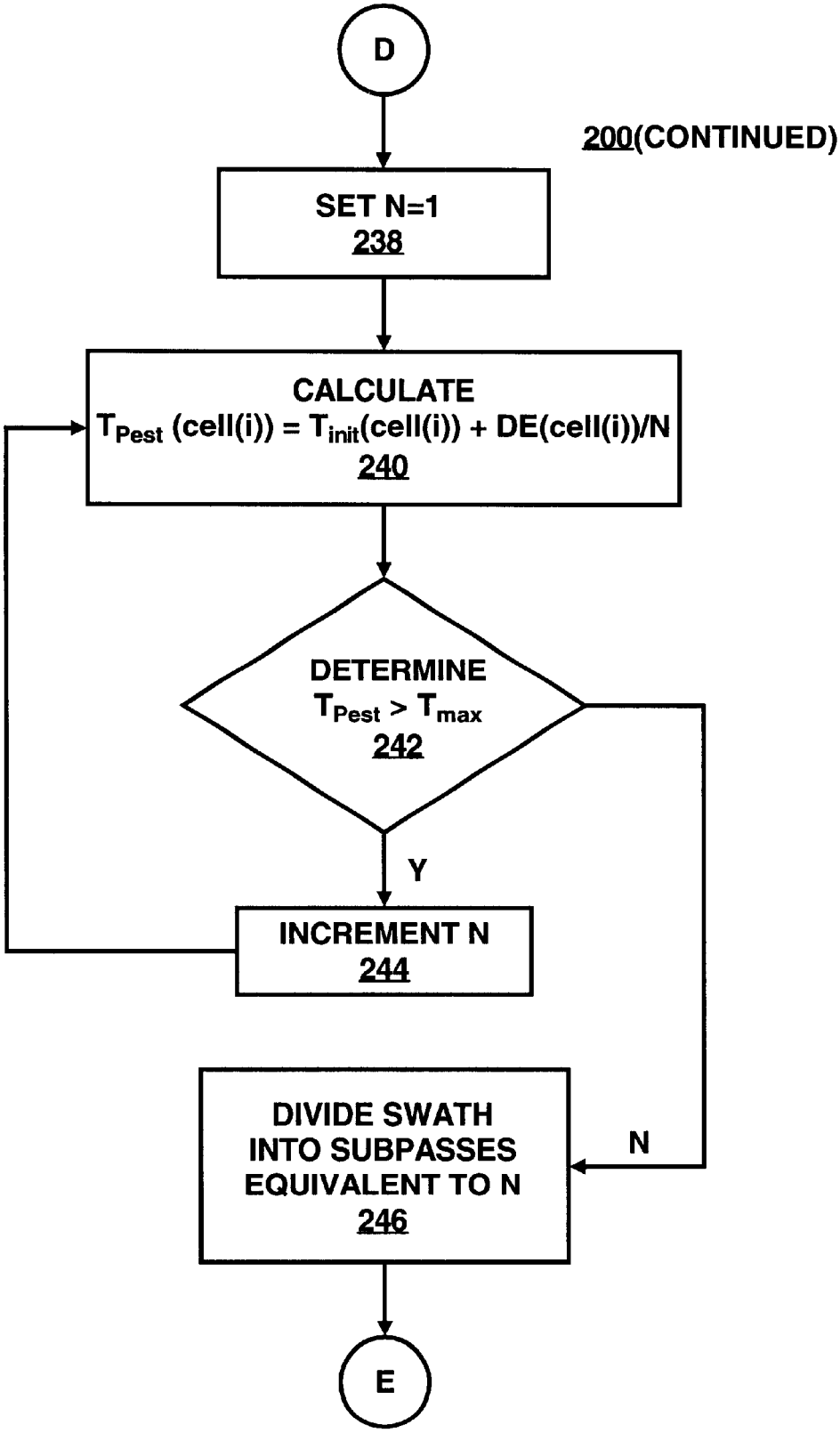

Returning to step 212 of FIG. 2A, if the estimated peak temperature, $T_{Pest}$, of each printhead 110 in printing any of the cells(i), is greater than the maximum allowed temperature, $T_{max}$, the ATPSS module 160 may be further configured to divide the pass of the swath into a series of sub-passes, as illustrated in steps 238–246 of FIG. 2D. The number of sub-passes utilized to print the swath may be calculated in an iterative manner based upon the estimated number of ink drops required to print a given cell (or drop estimate), DE(cell(i)) and a density divisor, N. In step 238, the density divisor may be initialized to 1, i.e., for a single pass in printing the swath. The ATPSS module 160 is further configured to calculate the estimated peak temperature, $T_{Pest}$ of each cell(i), by equation (4): $T_{Pest}$(cell(i))=$T_{init}$(cell(i))+DE(cell(i))/N, in step 240. Alternatively, equation (4) may be applied to the cell(i) that yielded the estimated printhead temperature that exceeded the predetermined maximum temperature. In either event, subsequently, the estimated peak temperature is compared to the allowed maximum temperature, $T_{max}$, in step 242.

If the estimated peak temperature, $T_{Pest}$, for each printhead 110 in printing a cell(i) exceeds the maximum allowed temperature, $T_{max}$, the ATPSS module 160 is further configured to increment the density divisor by one in step 244. The ATPSS module 160 then returns to step 242 to determine whether the estimated peak temperature, $T_{Pest}$, is greater than the maximum allowed temperature.

If the estimated peak temperature, $T_{Pest}$, is less than the maximum allowed temperature, $T_{max}$, the ATPSS module 160 is further configured to divide the pass of the given swath into a number of sub-passes equivalent to the density divisor, in step 246. Each sub-pass may be implemented by applying a respective submask. The sub-passes superimpose one another in a substantially exact manner with the same swath height as the original swath height. The sum of all the sub-passes is equal to the drop count for printing the swath in one pass. Otherwise, the ATPSS module 160 is configured to return to step 244 for the density divisor to be incremented by one.

Figure 2E:
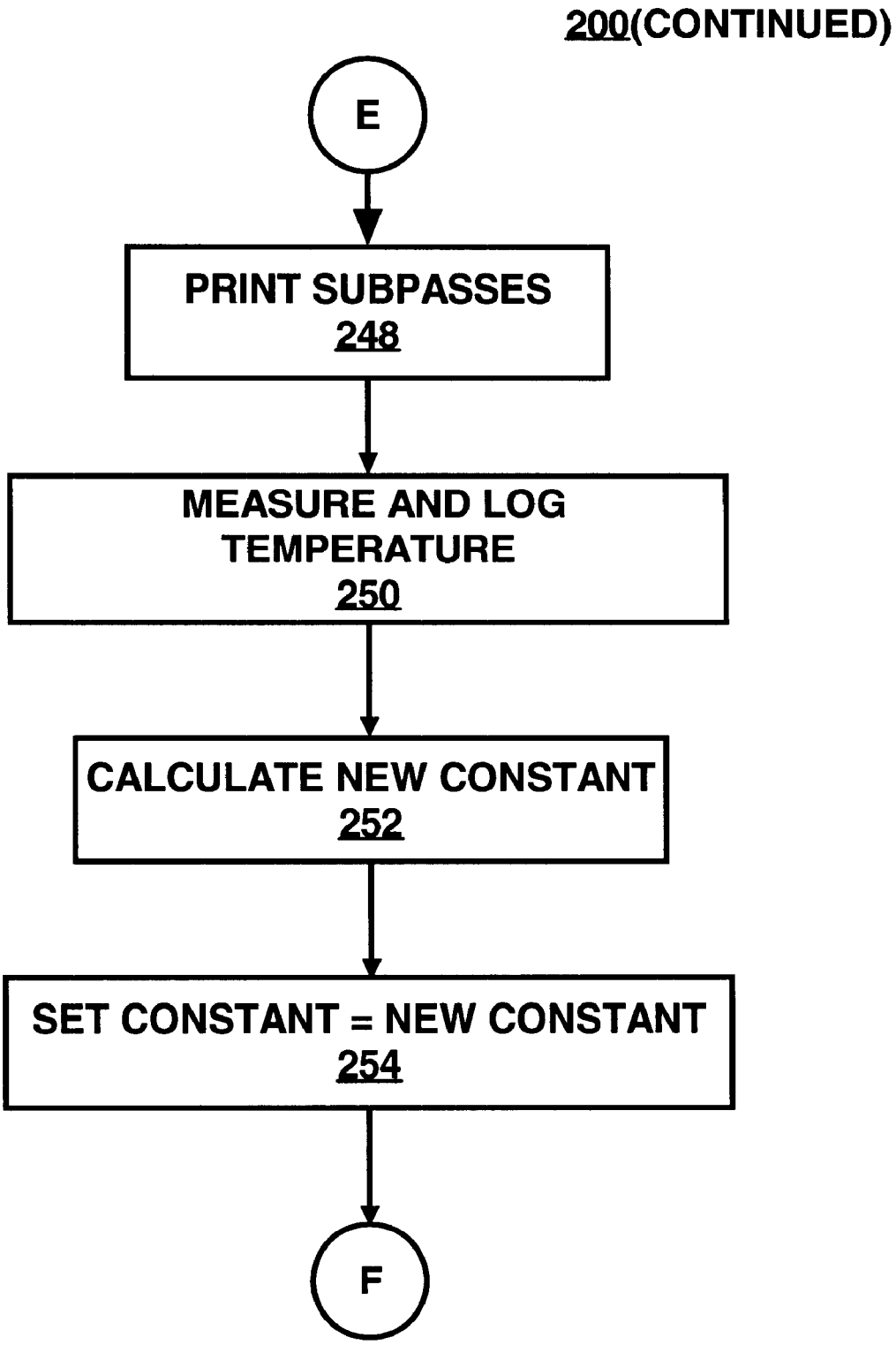

Referring to FIG. 2E, in step 248, the ATPSS module 160 may be further configured to print each sub-pass to full resolution. According to one aspect of the present invention, each sub-passes maintains the same swath height as the original pass. At the conclusion of the sub-passes, the ATPSS module 160 may be further configured to employ the temperatures measured and logged in step 250, while simultaneously printing to calculate (step 252) a new constant, $K_{new}$, using equation (2) as described herein above with respect to steps 218–234. In this regard, the conditions set forth hereinabove with respect to steps 218–234 generally dictate whether a new constant may be beneficial in equation (1). Thus, if those conditions are satisfied, then, in step 254, the new constant, $K_{new}$, is set as the constant, K, in equation (1) as described in step 236. The ATPSS module 160 is configured to return to step 206 for printing the next swath.

According to the principles of the present invention, the calculation of peak temperatures for each cell in a swath provides for a more accurate determination of whether the printheads of a printer may exceed a maximum operating temperature than is currently available. In this respect, the actual number of ink drops may be estimated for each cell, thus, even in the situation that a swath as a whole requires less ink drops than would typically cause the printheads to exceed a maximum temperature, if certain portions of the swath require ink drops that would cause the printheads to exceed the maximum temperature, the swath may be printed in sub-passes, to thus prevent the printheads from overheating. Thus, the present invention does not suffer from the drawbacks and disadvantages associated with known techniques for controlling the temperature of printheads.

The present invention may be performed as a computer program. The computer program may exist in a variety of forms both active and inactive. For example, the computer program can exist as software program(s) comprised of program instructions in source code, object code, executable code or other formats; firmware program(s); or hardware description language (HDL) files. Any of the above can be embodied on a computer readable medium, which include storage devices and signals, in compressed or uncompressed form. Exemplary computer readable storage devices include conventional computer system RAM (random access memory), ROM (read-only memory), EPROM (erasable, programmable ROM), EEPROM (electrically erasable, programmable ROM), and magnetic or optical disks or tapes. Exemplary computer readable signals, whether modulated using a carrier or not, are signals that a computer system hosting or running the present invention can be configured to access, including signals downloaded through the Internet or other networks. Concrete examples of the foregoing include distribution of executable software program(s) of the computer program on a CD ROM or via Internet download. In a sense, the Internet itself, as an abstract entity, is a computer readable medium. The same is true of computer networks in general.

While the invention has been described with reference to the exemplary embodiments thereof, those skilled in the art will be able to make various modifications to the described embodiments of the invention without departing from the true spirit and scope of the invention. The terms and descriptions used herein are set forth by way of illustration only and are not meant as limitations. In particular, although the method of the present invention has been described by examples, the steps of the method may be performed in a different order than illustrated or simultaneously. Those skilled in the art will recognize that these and other variations are possible within the spirit and scope of the invention as defined in the following claims and their equivalents.

What is claimed is:

1. A method of managing temperature in a printer, said method comprising the steps of:

preprocessing a file into a plurality of swaths;

preprocessing each of said swaths into a plurality of cells;

calculating an estimated peak temperature for each printhead in printing each of said plurality of cells;

printing said swath in response to said estimated peak temperature for each printhead in printing, each of said cells being below a predetermined maximum temperature;

measuring the temperature of each printhead prior to printing said swath;

employing said measured temperature as an initial temperature in calculating said estimated peak temperature for each printhead in printing a first cell of said swath; and employing said calculated estimated peak temperature for each printhead in printing said first cell as a second initial temperature in calculating a second estimated peak temperature for each printhead in printing a second cell.

2. The method of managing temperature in a printer according to claim 1, said method further comprising the steps of:

calculating an ink drop estimate for printing each cell; and employing said ink drop estimate for printing each cell to calculate said estimated peak temperature for each printhead in printing each cell.

3. The method of managing temperature in a printer according to claim 1, wherein said step of calculating an estimated peak temperature for each printhead in printing each of said cells includes the steps of estimating a number of ink drops required to print each cell, determining a quotient of said ink drop estimate over a constant, and adding the quotient to an initial temperature of each printhead.

4. The method of managing temperature in a printer according to claim 1, further comprising the step of:

dividing a pass of each printhead in printing said swath into a number of sub-passes in response to said estimated peak temperature for any printhead in printing any of said cells being greater than said predetermined maximum temperature; and wherein a number of ink drops printed during each said sub-pass is substantially less than a number of ink drops printed during a pass.

5. The method of managing temperature in a printer according to claim 4, comprising the step of:

calculating the number of sub-passes by determining the number of sub-passes required to maintain a predicted temperature of each printhead below said predetermined maximum temperature.

6. The method of managing temperature in a printer according to claim 4, wherein said pass dividing step comprises the further step of printing said sub-passes in a height that is substantially similar to the printing pass.

7. The method of managing temperature in a printer according to claim 4, wherein said pass dividing step comprises the further step of reducing the number of ink drops printed during each sub-pass and performing a sufficient number of sub-passes to cause said ink drops to be printed during a total of each sub-pass to substantially equal a total number of ink drops to be printed during said printing pass.

8. The method of managing temperature in a printer according to claim 4, wherein said step of dividing further comprises:

printing said number of sub-passes, wherein a recording medium is not advanced between each sub-pass of said number of sub-passes.

9. A method of managing temperature in a printer, said method comprising the steps of:

preprocessing a file into a plurality of swaths;

preprocessing each of said swaths into a plurality of cells;

calculating an estimated peak temperature for each printhead in printing each of said plurality of cells, wherein said step of calculating an estimated peak temperature for each printhead in printing each of said cells includes the substeps of:

estimating a number of ink drops required to print each cell, determining a quotient of said ink drop estimate over a constant, and adding the quotient to an initial temperature of each printhead;

printing said swath in response to said estimated peak temperature for each printhead in printing, each of said cells being below a predetermined maximum temperature;

measuring and logging an initial temperature of each printhead prior to printing each cell of said swath;

measuring and logging a final temperature of each printhead after printing each cell of said swath;

comparing the initial temperature of each printhead to the final temperature of each printhead for each cell, and determining a maximum temperature difference of each printhead in printing each of said cells;

measuring and logging number of ink drops printed during the printing of each cell of said swath; and determining a new constant by calculating the quotient of the number of ink drops printed over the maximum temperature difference for the cell in which the printhead had the maximum temperature difference.

10. The method of managing temperature in a printer according to claim 9, further comprising the step of:

setting said new constant as said constant in response to said new constant being within a predetermined maximum constant value and a predetermined minimum constant value.

11. The method of managing temperature in a printer according to claim 10, further comprising the steps of:

setting said predetermined maximum constant value as said constant in response to said new constant equaling or exceeding said predetermined maximum constant value; and maintaining said constant as said constant in response to said new constant equaling or falling below said predetermined minimum constant value.

12. The method of managing temperature in a printer according to claim 11, wherein said step of calculating an estimated peak temperature for each printhead in printing each of said cells includes the steps of estimating a number of ink drops required to print each cell, determining a quotient of said ink drop estimate over said new constant, and adding the quotient to an initial temperature of each printhead; and further comprising printing a second swath in response to said estimated peak temperature for each printhead in printing, each of said cells being below a predetermined maximum temperature.

13. The method of managing temperature in a printer according to claim 10, further comprising the step of:

maintaining said constant as said constant in response to said new constant equaling or falling below said predetermined minimum constant value.

14. A method of managing temperature in a printer, said method comprising the steps of:

preprocessing a file into a plurality of swaths;

preprocessing each of said swaths into a plurality of cells;

calculating an estimated peak temperature for each printhead in printing each of said plurality of cells;

printing said swath in response to said estimated peak temperature for each printhead in printing, each of said cells being below a predetermined maximum temperature;

dividing a pass of each printhead in printing said swath into a number of sub-passes in response to said estimated peak temperature for any printhead in printing any of said cells being greater than said predetermined maximum temperature, wherein a number of ink drops printed during each said sub-pass is substantially less than a number of ink drops printed during a pass;

calculating the number of sub-passes by determining the number of sub-passes required to maintain a predicted temperature of each printhead below said predetermined maximum temperature;

setting a density divisor to an initial number; and recalculating said peak estimate temperature by calculating a quotient of a drop estimate over said density divisor, wherein said quotient is added to an initial temperature of said printhead at a beginning of said cell.

15. The method of managing temperature in a printer according to claim 14, wherein said step of calculating the number of sub-passes further comprises:

incrementing said density divisor by one in response to said peak estimate temperature being greater than said predetermined temperature; and recalculating said peak estimate temperature with said incremented density divisor.

16. A computer readable storage medium on which is embedded one or more computer programs, said one or more computer programs implementing a method for managing temperature in a printer, said one or more computer programs comprising a set of instructions for:

preprocessing a printable file into a plurality of swaths, each swath being further preprocessed into a plurality of cells;

calculating an estimated peak temperature of at least one printhead in printing each cell;

printing said swath in response to said estimated peak temperature, each cell being below a predetermined maximum allowed temperature;

estimating a number of ink drops required to print each cell, determining a quotient of said ink drop estimate over a constant, and adding the quotient to an initial temperature of each printhead;

measuring and logging an initial temperature of each printhead prior to printing each cell of said swath;

measuring and logging a final temperature of each printhead after printing each cell of said swath;

comparing the initial temperature of each printhead to the final temperature of each printhead in printing each cell, and determining a maximum temperature difference of each printhead in printing each of said cells;

measuring and logging number of ink drops printed during the printing of each cell of said swath; and determining a new constant by calculating the quotient of the number of ink drops printed over the maximum temperature difference for the cell in which the printhead had the maximum temperature difference.

17. The computer readable storage medium in accordance to claim 16, said one or more computer programs further comprising a set of instructions for:

calculating an estimated density for said cell, wherein said estimated density is utilized to calculate said estimated peak temperature.

18. The computer readable storage medium in accordance to claim 17, said one or more computer programs further comprising a set of instructions for:

calculating said estimated peak temperature from a sum of a product of said estimated density and a constant and an initial temperature of each printhead prior to printing each said cell.

19. The computer readable storage medium in accordance to claim 16, said one or more computer programs further comprising a set of instructions for:

dividing a printing pass of each printhead in printing said swath into a number of sub-passes in response to said estimated peak temperature for any printhead in printing any of said cells being greater than said predetermined maximum temperature; and wherein a number of ink drops printed during each said sub-pass is substantially less than a number of ink drops printed during a pass.

20. The computer readable storage medium in accordance to claim 16, said one or more computer programs further comprising a set of instructions for:

setting said new constant as said constant in response to said new constant being within a predetermined maximum constant value and a predetermined minimum constant value.

21. A method of managing temperature in a printer comprising:

preprocessing a file into a plurality of swaths;

preprocessing a selected swath of said plurality of swaths into a plurality of cells;

calculating an estimated peak temperature for a printhead in printing at least one cell of said plurality of cells, said calculating step comprising the steps of:

estimating a number of ink drops required to print said at least one cell of said selected swath;

determining a quotient of said ink drop estimate over a constant; and adding the quotient to an initial temperature of said printhead; and printing said selected swath in response to said estimated peak temperature for said printhead in printing, said at least one cell being below a predetermined maximum temperature;

measuring and logging an initial temperature of said printhead prior to printing said at least one cell of said selected swath;

measuring and logging a final temperature of said printhead after printing said at least one cell of said selected swath;

comparing the initial temperature of said printhead to the final temperature of said printhead for said at least one cell, and determining a maximum temperature difference of said printhead in printing said at least one cell of said selected swath;

measuring and logging a number of ink drops printed during the printing of said at least one cell of said selected swath; and determining a new constant by calculating the quotient of the number of ink drops printed over the maximum temperature difference for a selected cell in which the printhead had the maximum temperature difference.

22. The method of managing temperature in a printer according to claim 21, further comprising the step of:

setting said new constant as said constant in response to said new constant being within a predetermined maximum constant value and a predetermined minimum constant value.

23. The method of managing temperature in a printer according to claim 22, further comprising the steps of:

setting said predetermined maximum constant value as said constant in response to said new constant equaling or exceeding said predetermined maximum constant value; and maintaining said constant as said constant in response to said new constant value equaling or falling below said predetermined minimum constant value.

24. The method of managing temperature in a printer according to claim 23, wherein said step of calculating an estimated peak temperature for said printhead in printing said at least one cell of said selected swath includes the steps of:

estimating a number of ink drops required to print said at least one cell of said selected swath;

determining a quotient of said ink drop estimate over said new constant;

adding the quotient to an initial temperature of said printhead; and printing a second swath in response to said estimated peak temperature for said printhead in printing, said at least one cell of said selected swath being below a predetermined maximum temperature.

25. A method of managing temperature in a printer, said method comprising the steps of:

preprocessing a file into a plurality of swaths;

preprocessing a selected swath of said plurality of swaths into a plurality of cells;

calculating an estimated peak temperature for a printhead in printing at least one cell of said plurality of cells;

printing said selected swath in response to said estimated peak temperature for said printhead in printing, said at least one cell being below a predetermined maximum temperature;

dividing a pass of said printhead in printing said selected swath into a number of sub-passes in response to said estimated peak temperature for said printhead in printing said at least one cell being greater than said predetermined maximum temperature wherein a number of ink drops printed during each said sub-pass is substantially less than a number of ink drops printed during a pass; and calculating the number of sub-passes by determining the number of sub-passes required to maintain a predicted temperature of said printhead below said predetermined maximum temperature, said calculating step comprising the steps of:

setting a density divisor to an initial number, and recalculating said peak estimate temperature by calculating a quotient of a drop estimate over said density divisor, wherein said quotient is added to an initial temperature of said printhead at a beginning of said at least one cell.

26. The method of managing temperature in a printer according to claim 25, wherein said step of calculating the number of sub-passes further comprises:

incrementing said density divisor by one in response to said peak estimate temperature being greater than said predetermined temperature; and recalculating said peak estimate temperature with said incremented density divisor.

27. A computer readable storage medium on which is embedded one or more computer programs, said one or more computer programs implementing a method for managing temperature in a printer, said one or more computer programs comprising a set of instructions for:

preprocessing a printable file into a plurality of swaths, each swath being further preprocessed into a plurality of cells; calculating an estimated peak temperature of at least one printhead in printing said at least one cell of a selected swath;

printing said selected swath in response to said estimated peak temperature, said at least one cell being below a predetermined maximum allowed temperature;

calculating an estimated density for said at least one cell, wherein said estimated density is utilized to calculate said estimated peak temperature; and calculating said estimated peak temperature from a sum of a product of said estimated density and a constant and an initial temperature of said at least one printhead prior to printing said at least one cell of said selected swath.

28. The computer readable storage medium in accordance to claim 27, said one or more computer programs further comprising a set of instructions for:

estimating a number of ink drops required to print said at least one cell, determining a quotient of said ink drop estimate over a constant, and adding the quotient to an initial temperature of said at least one printhead;

measuring and logging an initial temperature of said at least one printhead prior to printing said at least one cell of said selected swath;

measuring and logging a final temperature of said at least one printhead after printing said at least one cell of said selected swath;

comparing the initial temperature of said at least one printhead to the final temperature of said at least one printhead in printing said at least one cell of said selected swath, and determining a maximum temperature difference of said at least one printhead in printing said at least one cell;

measuring and logging number of ink drops printed during the printing of said at least one cell of said selected swath; and determining a new constant by calculating the quotient of the number of ink drops printed over the maximum temperature difference for the cell in which said at least one printhead had the maximum temperature difference.

29. The computer readable storage medium in accordance to claim 28, said one or more computer programs further comprising a set of instructions for:

setting said new constant as said constant in response to said new constant being within a predetermined maximum constant value and a predetermined minimum constant value.

30. A method of managing temperature in a printer comprising:

preprocessing a file into a plurality of swaths;

preprocessing a selected swath of said plurality of swaths into a plurality of cells;

calculating an estimated peak temperature for a printhead in printing at least one cell of said plurality of cells;

printing said selected swath in response to said estimated peak temperature for said printhead in printing, said at least one cell being below a predetermined maximum temperature;

measuring a temperature of said printhead prior to printing said selected swath;

employing said measured temperature as an initial temperature in calculating said estimated peak temperature for said printhead in printing said at least one cell of said swath; and employing said calculated estimated peak temperature for said printhead in printing said at least one cell as a second initial temperature in calculating a second estimated peak temperature for said printhead in printing a subsequent cell.

31. The method of managing temperature in a printer according to claim 30, said method further comprising the steps of:

calculating an ink drop estimate for printing at least one cell of said selected swath; and employing said ink drop estimate for printing said at least one cell of said selected swath to calculate said estimated peak temperature for said printhead in printing said at least one cell.

32. The method of managing temperature in a printer according to claim 30, wherein said step of calculating an estimated peak temperature for said printhead in printing said at least one cell of said selected swath includes the steps of estimating a number of ink drops required to print said at least one cell of said selected swath, determining a quotient of said ink drop estimate over a constant, and adding the quotient to an initial temperature of said printhead.

33. The method of managing temperature in a printer according to claim 30, further comprising the step of:

dividing a pass of said printhead in printing said selected swath into a number of sub-passes in response to said estimated peak temperature for said printhead in printing said at least one cell being greater than said predetermined maximum temperature wherein a number of ink drops printed during each said sub-pass is substantially less than a number of ink drops printed during a pass.

34. The method of managing temperature in a printer according to claim 33, further comprising the step of:

calculating the number of sub-passes by determining the number of sub-passes required to maintain a predicted temperature of said printhead below said predetermined maximum temperature.

35. A method of managing temperature in a printer comprising:

preprocessing a file into a plurality of swaths;

preprocessing a selected swath of said plurality of swaths into a plurality of cells;

calculating an estimated peak temperature for a printhead in printing at least one cell of said plurality of cells;

printing said selected swath in response to said estimated peak temperature for said printhead in printing, said at least one cell being below a predetermined maximum temperature, wherein said step of calculating an estimated peak temperature for said printhead in printing said at least one cell of said selected swath includes the steps of estimating a number of ink drops required to print said at least one cell of said selected swath, determining a quotient of said ink drop estimate over a constant, and adding the quotient to an initial temperature of said printhead;

measuring and logging an initial temperature of said printhead prior to printing said at least one cell of said selected swath;

measuring and logging a final temperature of said printhead after printing said at least one cell of said selected swath;

comparing the initial temperature of said printhead to the final temperature of said printhead for said at least one cell, and determining a maximum temperature difference of said printhead in printing said at least one cell of said selected swath;

measuring and logging a number of ink drops printed during the printing of said at least one cell of said selected swath; and determining a new constant by calculating the quotient of the number of ink drops printed over the maximum temperature difference for a selected cell in which the printhead had the maximum temperature difference.

36. The method of managing temperature in a printer according to claim 35, further comprising the steps of:

setting said new constant as said constant in response to said new constant being within a predetermined maximum constant value and a predetermined minimum constant value;

setting said predetermined maximum constant value as said constant in response to said new constant equaling or exceeding said predetermined maximum constant value; and maintaining said constant as said constant in response to said new constant value equaling or failing below said predetermined minimum constant value.

37. The method of managing temperature in a printer according to claim 36, wherein said step of calculating an estimated peak temperature for said printhead in printing said at least one cell of said selected swath includes the steps of:

estimating a number of ink drops required to print said at least one cell of said selected swath;

determining a quotient of said ink drop estimate over said new constant;

adding the quotient to an initial temperature of said printhead; and printing a second swath in response to said estimated peak temperature for said printhead in printing, said at least one cell of said selected swath being below a predetermined maximum temperature.

38. A method of managing temperature in a printer comprising:

preprocessing a file into a plurality of swaths;

preprocessing a selected swath of said plurality of swaths into a plurality of cells;

calculating an estimated peak temperature for a printhead in printing at least one cell of said plurality of cells;

printing said selected swath in response to said estimated peak temperature for said printhead in printing, said at least one cell being below a predetermined maximum temperature;

dividing a pass of said printhead in printing said selected swath into a number of sub-passes in response to said estimated peak temperature for said printhead in printing said at least one cell being greater than said predetermined maximum temperature wherein a number of ink drops printed during each said sub-pass is substantially less than a number of ink drops printed during a pass; and dividing a pass of said printhead in printing said selected swath into a number of sub-passes in response to said estimated peak temperature for said printhead in printing said at least one cell being greater than said predetermined maximum temperature wherein a number of ink drops printed during each said sub-pass is substantially less than a number of ink drops printed during a pass, wherein said step of calculating the number of sub-passes further comprises:

setting a density divisor to an initial number and recalculating said peak estimate temperature by calculating a quotient of a drop estimate over said density divisor, wherein said quotient is added to an initial temperature of said printhead at a beginning of said at least one cell.

39. A computer readable storage medium on which is embedded one or more computer programs, said one or more computer programs implementing a method for managing temperature in a printer, said one or more computer programs comprising a set of instructions for:

preprocessing a printable file into a plurality of swaths, each swath being further preprocessed into a plurality of cells;

calculating an estimated peak temperature of at least one printhead in printing said at least one cell of a selected swath;

printing said selected swath in response to said estimated peak temperature, said at least one cell being below a predetermined maximum allowed temperature;

estimating a number of ink drops required to print said at least one cell, determining a quotient of said ink drop estimate over a constant, and adding the quotient to an initial temperature of said at least one printhead;

measuring and logging an initial temperature of said at least one printhead prior to printing said at least one cell of said selected swath;

measuring and logging a final temperature of said at least one printhead after printing said at least one cell of said selected swath;

comparing the initial temperature of said at least one printhead to the final temperature of said at least one printhead in printing said at least one cell of said selected swath, and determining a maximum temperature difference of said at least one printhead in printing said at least one cell;

measuring and logging number of ink drops printed during the printing of said at least one cell of said selected swath; and determining a new constant by calculating the quotient of the number of ink drops printed over the maximum temperature difference for the cell in which said at least one printhead had the maximum temperature difference.

40. The computer readable storage medium in accordance to claim 39, said one or more computer programs further comprising a set of instructions for:

calculating an estimated density for said at least one cell, wherein said estimated density is utilized to calculate said estimated peak temperature.

41. The computer readable storage medium in accordance to claim 40, said one or more computer programs further comprising a set of instructions for:

calculating said estimated peak temperature from a sum of a product of said estimated density and a constant and an initial temperature of said at least one printhead prior to printing said at least one cell of said selected swath.

42. The computer readable storage medium in accordance to claim 39, said one or more computer programs further comprising a set of instructions for:

dividing a printing pass of said at least one printhead in printing said selected swath into a number of sub-passes in response to said estimated peak temperature for said at least one printhead in printing said at least one cell being greater than said predetermined maximum allowed temperature; and wherein a number of ink drops printed during each said sub-pass is substantially less than a number of ink drops printed during a pass.

* * * * *